US008037632B2

(12) United States Patent
Pikielny

(10) Patent No.: US 8,037,632 B2
(45) Date of Patent: Oct. 18, 2011

(54) IDENTIFICATION CONTROL OF FIREARM

(76) Inventor: Dov Pikielny, Herzliya (IL)

( * ) Notice: Subject to any disclaimer, the term of this patent is extended or adjusted under 35 U.S.C. 154(b) by 974 days.

(21) Appl. No.: 11/751,641

(22) Filed: May 22, 2007

(65) Prior Publication Data

US 2008/0289237 A1 Nov. 27, 2008

(51) Int. Cl.
*F41A 17/06* (2006.01)
*F41A 17/46* (2006.01)

(52) U.S. Cl. ..... 42/70.06; 42/70.11

(58) Field of Classification Search ..... 42/70.01–70.11
See application file for complete search history.

(56) References Cited

U.S. PATENT DOCUMENTS 5,502,915 A * 4/1996 Mendelsohn et al. ..... 42/70.11
6,286,240 B1 * 9/2001 Collins ..... 42/70.08
6,286,242 B1 * 9/2001 Klebes ..... 42/84
6,321,478 B1 * 11/2001 Klebes ..... 42/84
6,563,940 B2 * 5/2003 Recce ..... 382/120
6,817,130 B2 * 11/2004 Ivanov ..... 42/70.06
2002/0170220 A1 * 11/2002 Recce ..... 42/70.08
2004/0031180 A1 * 2/2004 Ivanov ..... 42/70.11
2008/0289237 A1 * 11/2008 Pikielny ..... 42/70.11

* cited by examiner

*Primary Examiner* — Troy Chambers
(74) *Attorney, Agent, or Firm* — Dekel Patent Ltd.; David Klein

(57) ABSTRACT

A firearm including a trigger-actuated firing mechanism, a safety device that selectively prevents and permits the firing mechanism to be actuated, and an authentication device that cooperates with the safety device and which recognizes a feature of an authorized shooter, wherein the safety device is nominally in a position that permits the firing mechanism to be actuated and is moved to a position that prevents the firing mechanism from being actuated only if the authentication device does not recognize a would-be shooter as an authorized shooter.

11 Claims, 3 Drawing Sheets

IDENTIFICATION CONTROL OF FIREARM

FIELD OF THE INVENTION

This invention relates generally to firearms, and particularly to a system for permitting firing a firearm based on identification of the shooter.

BACKGROUND OF THE INVENTION

Many devices are known for preventing a firearm from being used by an unauthorized person, such as children or other non-owners. For example, U.S. Pat. No. 6,357,156 describes a system for use with an electronic firearm. The system has a fingerprint sensor used to compare the sensed fingerprint pattern of a would-be shooter with an authorized user's fingerprint pattern stored in an identification circuit. The identification circuit communicates with an electrical interface for transmitting an authorization signal to activate the firearm if the sensed fingerprint pattern substantially matches the authorized user's fingerprint pattern. The system is powered by DC batteries.

U.S. Pat. No. 6,711,843 describes an electronic firearm that includes a barrel assembly and a handle assembly coupled to the barrel assembly. The handle assembly includes a grip portion defining a cavity and one or more openings disposed generally at a rear side of the grip portion. A biometric sensing device is disposed within the cavity and aligned with the openings of the grip portion for scanning the skin of a portion of the user's hand to determine whether the user is authorized to discharge the electronic firearm.

U.S. Pat. No. 4,970,819 describes a system in which actuation of the firing mechanism of a firearm is prevented until grip pattern sensing means on the handgrip of the firearm supply to a microprocessor signals corresponding to a grip pattern stored in a programmed simulated neural network memory.

In all of the known systems of the prior art, the firearm is normally inoperable (that is, cannot be used to fire a projectile) unless the system recognizes the shooter as an authorized shooter. In other words, something blocks or interferes with the firing mechanism and that something moves away to allow the firing mechanism to work only upon recognition of the shooter as an authorized shooter.

SUMMARY OF THE INVENTION

The present invention seeks to provide a new concept for permitting firing a firearm based on identification of the shooter, as is described in detail further hereinbelow. In direct contrast to the prior art, in the present invention, the firearm is normally operable (that is, it can be used to fire a projectile) unless the system recognizes the shooter as an unauthorized shooter. In other words, the firing mechanism is normally free to operate properly, and something blocks or interferes with the firing mechanism only upon recognition of the shooter as an unauthorized shooter.

This subtle difference has very significant and possibly life saving ramifications over the prior art. For example, in the prior art, if the authorized user wishes to shoot and the system malfunctions and does not recognize the rightful owner, the firearm is useless and the rightful owner could be in a potentially life threatening situation. In the present invention, the rightful owner always can use the firearm and is not in danger of misidentification. Although in the present invention if a criminal steals the firearm from a law enforcement person or a legitimate owner and the system malfunctions the criminal will be able to use the firearm, it is believed that such as scenario is less likely to happen. In any case it is much more important to allow the authorized person to shoot no matter what as opposed to the prior art which does not allow that in the event of a malfunction.

A related advantage of the present invention over the prior art is the consequence of loss of battery power. In the prior art, once the battery is out of power, the firing mechanism of the firearm is blocked and the firearm cannot function. In contrast, in the present invention, if the power is off (e.g., not working, malfunctioning, battery dead, electrical malfunction) the firing mechanism of the firearm is not blocked and the firearm can function normally.

Another advantage of the present invention is that it provides indemnification of the firearm manufacturer, that is, it secures the manufacturer against liability for any malfunctioning of the firearm, since the firearm is nominally operable as opposed to the prior art in which the firearm is nominally inoperable.

There is thus provided in accordance with an embodiment of the present invention a firearm including a trigger-actuated firing mechanism, a safety device that selectively prevents and permits the firing mechanism to be actuated, and an authentication device that cooperates with the safety device and which recognizes a feature of an authorized shooter, wherein the safety device is nominally in a position that permits the firing mechanism to be actuated and is moved to a position that prevents the firing mechanism from being actuated only if the authentication device does not recognize a would-be shooter as an authorized shooter. In one non-limiting embodiment, a solenoid moves the safety device to the position that prevents the firing mechanism from being actuated.

The authentication device may include a grip pattern sensing device on a handgrip of the firearm. The grip pattern of an authorized user may be stored in a memory in the firearm. A port may be provided for communicating data to and from the memory. The grip pattern sensing device may be a fingerprint sensor device or a biometric sensing device, for example, or any other authentication device.

There is also provided in accordance with an embodiment of the present invention method for using a firearm, the firearm including a trigger-actuated firing mechanism and a safety device that selectively prevents and permits the firing mechanism to be actuated, the method including providing an authentication device that cooperates with the safety device and which recognizes a feature of an authorized shooter, wherein the safety device is nominally in a position that permits the firing mechanism to be actuated and is moved to a position that prevents the firing mechanism from being actuated only if the authentication device does not recognize a would-be shooter as an authorized shooter.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
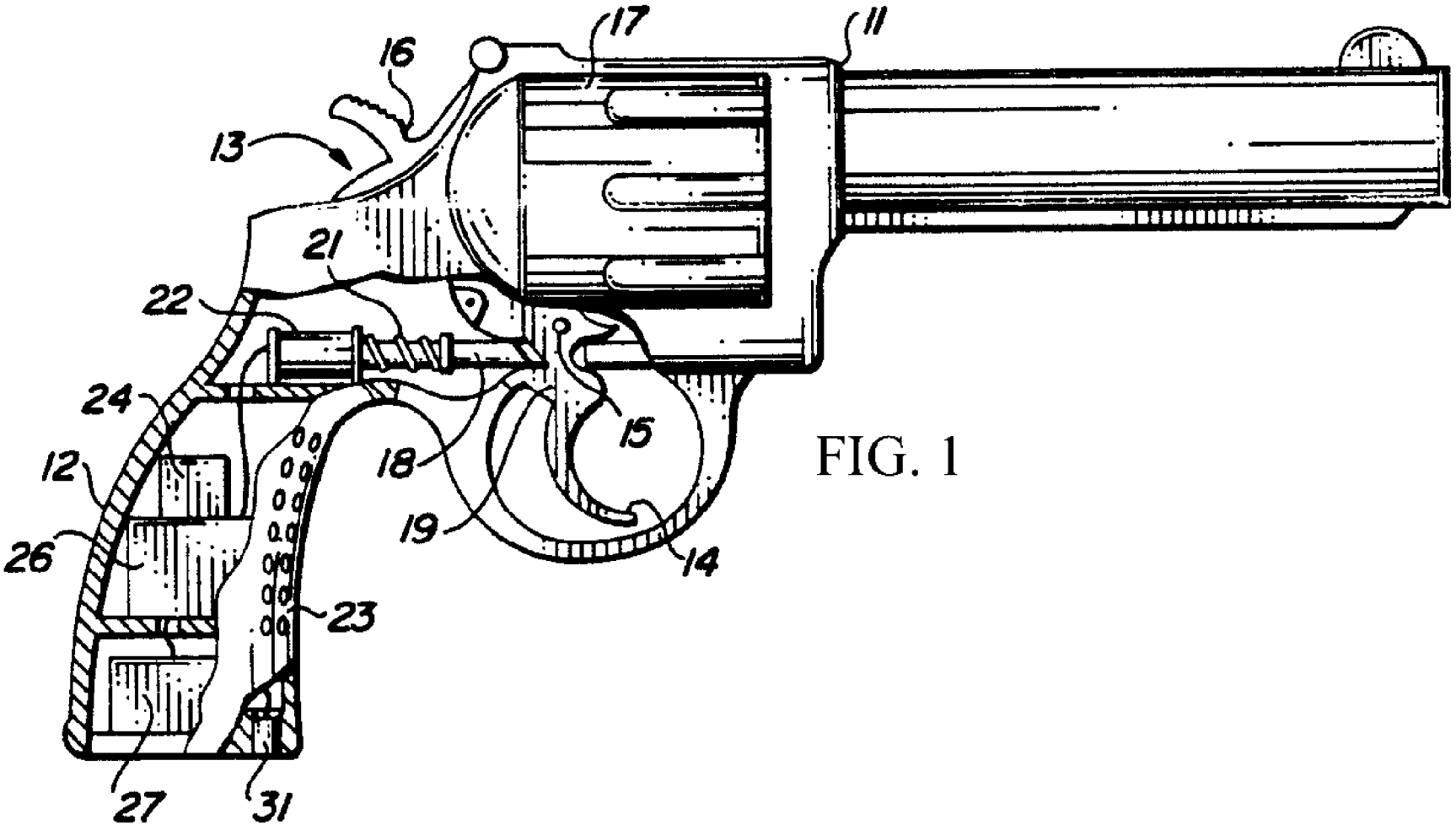
FIG. 1 is a simplified pictorial illustration of a firearm, constructed and operative in accordance with an embodiment of the present invention.

Reference is now made to FIG. 1, which illustrates a firearm 11, constructed and operative in accordance with an embodiment of the present invention. Merely for convenience, firearm 11 is illustrated as in U.S. Pat. No. 4,970,819 and will be described as a revolver-type handgun, but the invention is not limited to revolvers and may be carried out with any type of firearm (including metal frames, polymer frames and any other material or combination of materials), such as semi-automatic handguns (with magazines), different types of rifles (including but not limited to sniper rifles), shot guns etc., and less than lethal or non-lethal device, such as but not limited to, tasers, electric shockers, tear gas devices, etc. Firearm 11 is of more or less conventional mechanical construction, and comprises, inter alia, a handgrip 12 and a firing mechanism 13.

Firing mechanism 13 includes a finger actuated trigger 14 pivotally mounted in the frame of the gun at 15. Movement of trigger 14 cocks and then releases a hammer 16 to fire a shell (not shown) in a rotatable cartridge cylinder 17.

Firearm 11 is equipped with a safety device which prevents and permits the firing mechanism 13 to be actuated. In the non-limiting embodiment, the safety is a sliding latch member 18 adapted to engage a pawl 19 on trigger 14. Latch member 18 is biased by a spring 21 to the right as shown in FIG. 1 to a position in which it is in the path of movement of pawl 19 on trigger 14 when the latter is swung about pivot 15.

Figure 2A:
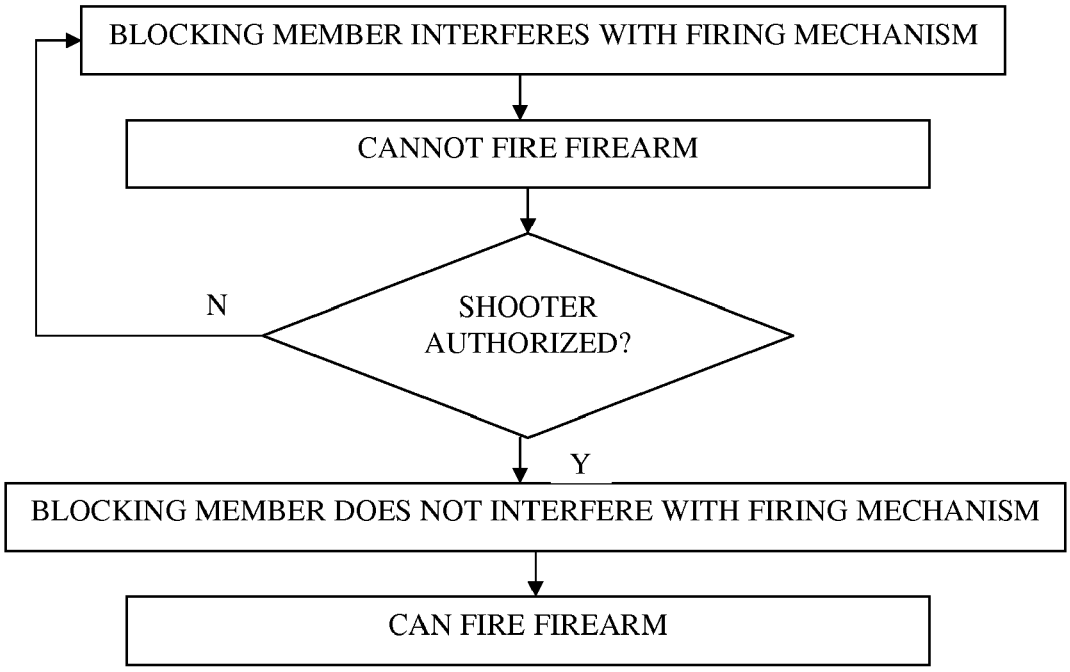
FIG. 2A PRIOR ART
FIG. 2A is a simplified flow chart of a prior art system in which the firearm is normally inoperable unless the system recognizes the shooter as an authorized shooter.

In the prior art, as shown in FIG. 2A, firearm 11 is normally inoperable unless the system recognizes the shooter as an authorized shooter. In the non-limiting example of U.S. Pat. No. 4,970,819, this means a blocking member (latch member 18) will always interfere with firing mechanism 13 and will move away to allow firing mechanism 13 to work only upon recognition of the shooter as an authorized shooter. More specifically, the nominal position of latch member 18 prevents movement of trigger 14 and, hence, prevents actuation of the firing mechanism. In the prior art, latch member 18 is adapted to be retracted (moved to the left from the position shown in FIG. 1) by a solenoid to a position clear of the path of travel of trigger pawl 19. With latch member 18 in its retracted position, the firing mechanism can be actuated to discharge the firearm.

The position of latch member 18 is controlled and determined by whether the firearm is held by an authorized user or by an unauthorized user. In the prior art, the control is such that the prior art solenoid is energized to retract latch member 18 only when the handgrip 12 is gripped by the hand of the authorized user of the firearm. A grip pattern sensing device on the handgrip 12 is coupled with a processor for distinguishing between the grip pattern of the authorized user and the grip patterns of others.

Figure 2B:
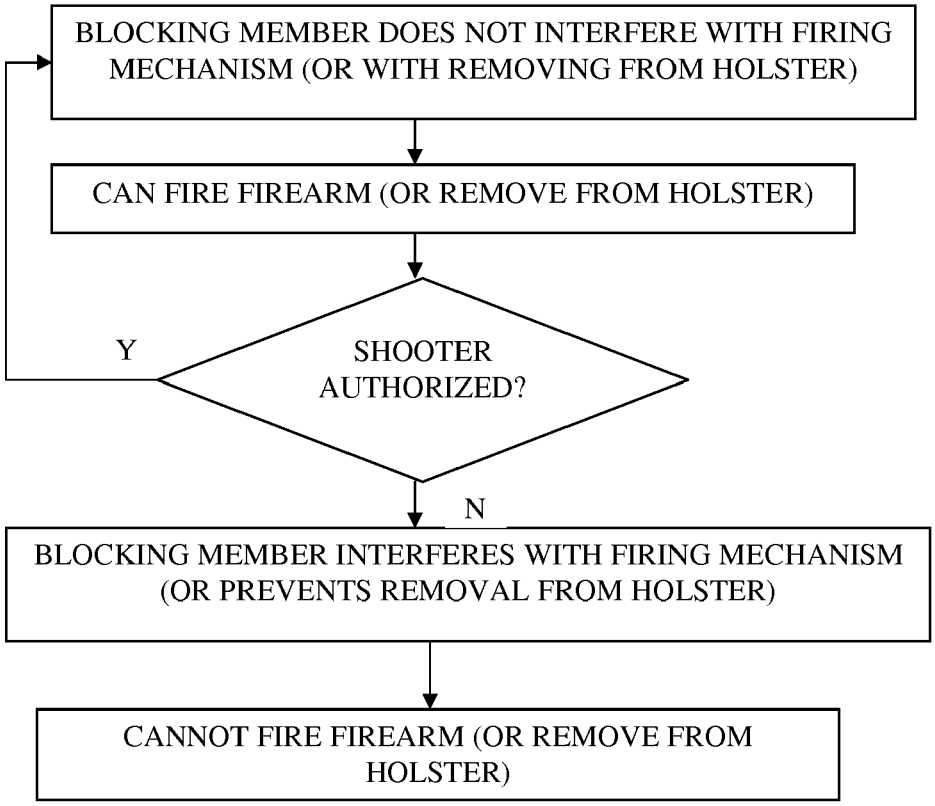
FIG. 2B is a simplified flow chart of a system in accordance with an embodiment of the present invention, in which the firearm is normally operable unless the system recognizes the shooter as an unauthorized shooter.

In the present invention, as shown in FIG. 2B, in direct contradistinction to the prior art, firearm 11 is normally operable unless the system recognizes the shooter as an unauthorized shooter. The nominal position of latch member 18 does not prevent movement of trigger 14. That is, latch member 18 is nominally in a position clear of the path of travel of trigger pawl 19. With latch member 18 in this position, the firing mechanism can be actuated to discharge the firearm. In the present invention, latch member 18 is adapted to be deployed (moved to the right in the sense of FIG. 1) by a solenoid 22 to a position that blocks movement of trigger pawl 19. With latch member 18 in the deployed position, the firing mechanism cannot be actuated to discharge the firearm.

The position of latch member 18 is controlled and determined by whether the firearm is held by an authorized user or by an unauthorized user. In the present invention, the control is such that the solenoid 22 is energized to deploy latch member 18 to the blocking position only when the handgrip 12 is gripped by the hand of an unauthorized user of the firearm. A grip pattern sensing device 23 on the handgrip 12 is coupled with a processor 26 for distinguishing between the grip pattern of the authorized user and the grip patterns of others. The grip pattern(s) of the authorized user(s) may be stored in a memory 24. Data may be uploaded to or downloaded from memory 24 via a port 31 (such as a USB port). A battery 27 (in the grip 12) powers the various elements of the system.

The grip pattern sensing device 23 may include, without limitation, a fingerprint sensor device as described in U.S. Pat. No. 6,357,156 or a simulated neural network memory as described in U.S. Pat. No. 4,970,819, the disclosures of which are incorporated herein by reference. Grip pattern sensing device 23 may include, without limitation, a biometric sensing device as described in U.S. Pat. No. 6,711,843, the disclosure of which is incorporated herein by reference.

The grip pattern sensing device 23 is illustrated as being in the back strap of the handgrip 12 (although device 23 may be placed in other portions of the grip or other portions of the firearm). The back strap may be a replaceable back strap (as described in co-pending US patent application, the disclosure of which is incorporated herein by reference) that of the invention can incorporate a recognition device (e.g., "finger print"/"palm print recognition device") capable of recognizing/identifying the shooter's hand. The recognition device permits unlocking the weapon only for an authorized user or keeping it locked for anyone unauthorized.

Lockable firearm holsters with fingerprint identification devices are also known. For example, U.S. Pat. No. 6,320,975 describes a retaining device for a holster including a fingerprint input device positioned upon the external surface of the holster. An inputted fingerprint is sensed and compared with a stored fingerprint image. If the inputted fingerprint matches a stored authorized fingerprint, the weapon can be removed from the holster. Otherwise, the weapon cannot be removed from the holster.

In contrast, in the present invention, the opposite is true. The weapon can always be removed from the holster unless the inputted fingerprint does not match a stored authorized fingerprint.

Figure 3:
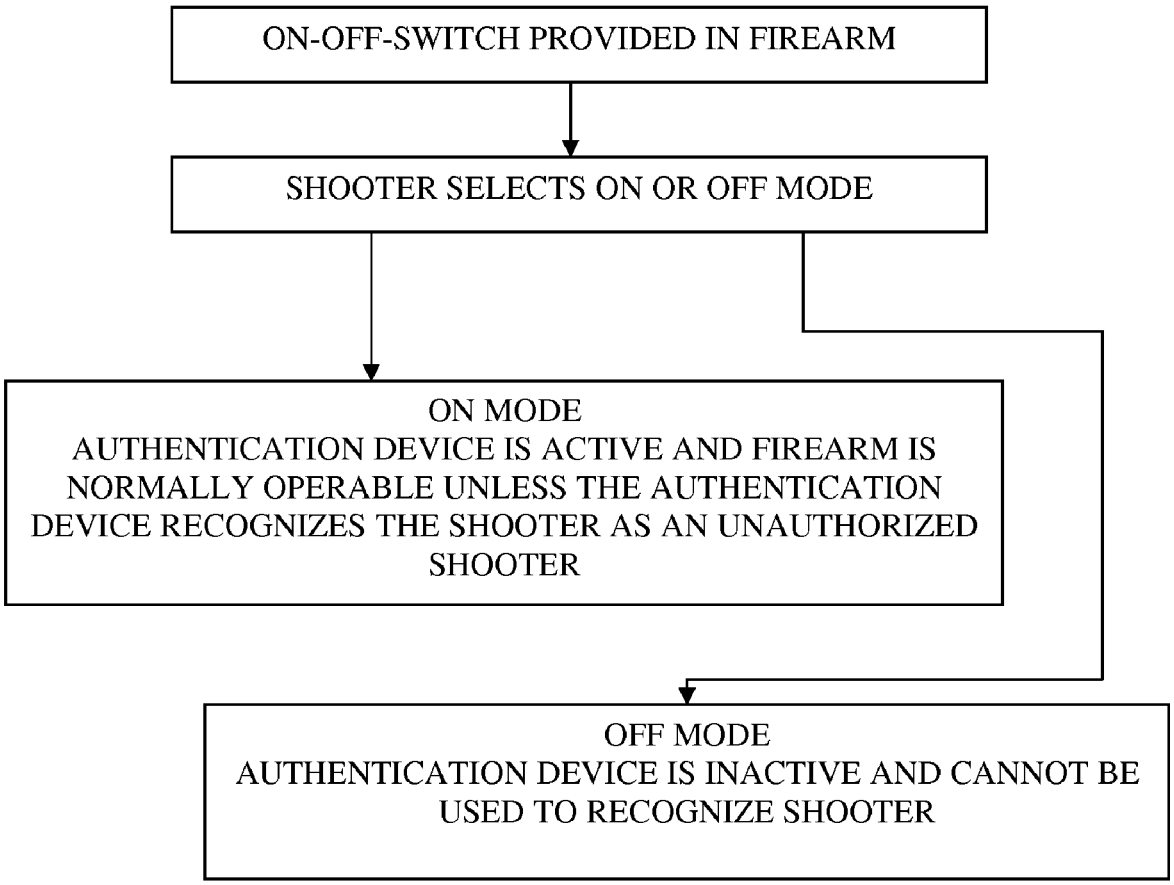
FIG. 3 is a simplified flow chart of a system in accordance with another embodiment of the present invention, in which the shooter can select to place the firearm in an off or on mode, particularly useful for shooting with gloves.

Reference is now made to FIG. 3, which illustrates a flow chart of a system in accordance with another embodiment of the present invention. In this embodiment, an on-off-switch is provided and the shooter can select to place the firearm in the off mode or the on mode. The on mode is as described above, wherein the authentication device is active and the firearm is normally operable unless the authentication device recognizes the shooter as an unauthorized shooter. In the off mode, the authentication device is inactive and cannot be used to recognize a biometric parameter of the shooter. The off mode is particularly useful for shooting with gloves. Gloves are not normally used when the shooter is using the gun for self defense. However, gloves are used by professional shooters during training and combat. With the on-off selector, the shooter can decide whether the system is operable or non-operable, e.g., when gloves are worn.

It is noted that the system can be retrofit to existing firearms and can be incorporated into any mechanical locking system that already exists on the firearm, which will be locked when a non-authorized person is sensed.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A firearm comprising:

a trigger-actuated firing mechanism;

a safety device that selectively prevents and permits said firing mechanism to be actuated; and an authentication device that cooperates with said safety device and which recognizes a feature of an authorized shooter, wherein said safety device is nominally in a position that permits said firing mechanism to be actuated and is moved to a position that prevents said firing mechanism from being actuated only if said authentication device does not recognize a would-be shooter as an authorized shooter.

2. The firearm according to claim 1, further comprising a solenoid that moves said safety device to the position that prevents said firing mechanism from being actuated.

3. The firearm according to claim 1, wherein said authentication device comprises a grip pattern sensing device on a handgrip of said firearm.

4. The firearm according to claim 3, wherein a grip pattern of an authorized user is stored in a memory in said firearm.

5. The firearm according to claim 4, further comprising a port for communicating data to and from said memory.

6. The firearm according to claim 3, wherein said grip pattern sensing device comprises a fingerprint sensor device.

7. The firearm according to claim 3, wherein said grip pattern sensing device comprises a biometric sensing device.

8. The firearm according to claim 1, further comprising an on-off-switch for selecting to place said firearm in an off mode or an on mode, wherein in the on mode said authentication device is active and said firearm is normally operable unless said authentication device recognizes a shooter as an unauthorized shooter, and wherein in the off mode said authentication device is inactive and cannot be used to recognize a shooter.

9. A method for using a firearm, said firearm including a trigger-actuated firing mechanism and a safety device that selectively prevents and permits said firing mechanism to be actuated, the method comprising:

providing an authentication device that cooperates with said safety device and which recognizes a feature of an authorized shooter, wherein said safety device is nominally in a position that permits said firing mechanism to be actuated and is moved to a position that prevents said firing mechanism from being actuated only if said authentication device does not recognize a would-be shooter as an authorized shooter.

10. The firearm according to claim 1, wherein said authentication device senses a biometric or fingerprint feature of the would-be shooter, and said safety device is moved to the position that prevents said firing mechanism from being actuated only if said authentication device does not recognize the biometric or fingerprint feature of the would-be shooter as an authorized shooter.

11. The method according to claim 9, comprising using said authentication device to sense a biometric or fingerprint feature of the would-be shooter, and moving said safety device to the position that prevents said firing mechanism from being actuated only if said authentication device does not recognize the biometric or fingerprint feature of the would-be shooter as an authorized shooter.

* * * * *